US008365363B2

(12) United States Patent
Chen

(10) Patent No.: US 8,365,363 B2
(45) Date of Patent: Feb. 5, 2013

(54) STRAP FASTENING DEVICE

(76) Inventor: Chien-Rung Chen, Taipei (TW)

( * ) Notice: Subject to any disclaimer, the term of this patent is extended or adjusted under 35 U.S.C. 154(b) by 479 days.

(21) Appl. No.: 12/646,732

(22) Filed: Dec. 23, 2009

(65) Prior Publication Data

US 2011/0146036 A1 Jun. 23, 2011

(51) Int. Cl.
*A44B 11/26* (2006.01)

(52) U.S. Cl. ..... 24/163 R; 2/418; 2/426; 24/68 E; 24/191; 24/265 BC

(58) Field of Classification Search ..... None
See application file for complete search history.

(56) References Cited

U.S. PATENT DOCUMENTS 6,219,851 B1 * 4/2001 Fang ..... 2/418
2006/0032027 A1 * 2/2006 Shiue ..... 24/191

FOREIGN PATENT DOCUMENTS

TW 239925 2/1995

* cited by examiner

*Primary Examiner* — Jack W. Lavinder
(74) *Attorney, Agent, or Firm* — Muncy, Geissler, Olds & Lowe, PLLC

(57) ABSTRACT

A strap fastening device includes two fastening straps and a tightness adjusting unit. The fastening straps each have a fixing end and an opposing free end. The tightness adjusting unit includes an assembling box and two locating members. The assembling box is provided at a left and a right half with at least one non-return retaining tooth each. The two locating members are slidably mounted to the assembling box and connected to the free ends of the two fastening straps, such that the free ends of the fastening straps are not turned back to expose from the assembling box. The slidable locating members respectively have a raised locating rib releasably engaging with the at least one non-return retaining tooth at the left and the right half of the assembling box. The two locating members can be conveniently slid with one hand to adjust the tightness of the fastening straps.

15 Claims, 8 Drawing Sheets

STRAP FASTENING DEVICE

FIELD OF THE INVENTION

The present invention relates to a strap fastening device, and more particularly to a strap fastening device that is configured for connecting to two opposite ends of an object and is adjustable to provide different levels of tightness thereof.

BACKGROUND OF THE INVENTION

A fastening strap is frequently connected to an object, such as a diving mask, a pair of swimming goggles, a fin, or a pair of snow goggles, for tightly holding the object to a wearer. Generally, the fastening strap is connected to and between two opposite ends of the object and is adjustable in tightness, allowing the object to be comfortably worn on the wearer's body area, such as the wearer's head or feet, to where the object is fitted.

Conventionally, the fastening strap is usually integrally formed using an elastic material, such as silicon rubber or rubber. Two opposite free ends of the fastening strap are movably extended through, for example, two buckles connected to two opposite ends of the object and turned back to be held to the buckles. By pulling the turn-back free ends of the fastening strap, the tightness of the object against the wearer's body area can be adjusted.

The above conventional fastening strap has the disadvantages of inconvenient to handle, uneven tightness, and tending to interfere with other nearby devices. Among others, Taiwan Patent Publication No. 239925 discloses an improved fastening strap, which includes a curved assembling plate, two straps, and two push plates. The curved assembling plate is provided on an outer surface near two opposite ends with two laterally symmetrical slots, and two opposite ends of the curved assembling plate are formed into two open entrances equipped with a shaft each. The curved assembling plate is provided at predetermined positions with retaining holes for engaging with retaining hooks provided on the push plates. The straps are made of an elastic material to thereby provide a certain degree of lengthwise elasticity. Each of the straps is provided with a plurality of non-return retaining teeth protruded from an outer surface of the strap. The non-return retaining teeth allow the straps under pressure to be pulled outward but stop the outward pulled straps from retracting reversely. The straps are movably connected at respective fixing ends to two opposite sides of a frame of an object. The free ends of the straps are separately extended through the two slots on the curved assembling plate to wind around the shaft each before being outward turned back to expose from an outer side of the assembling plate to form two turn-back sections. Meanwhile, the non-return retaining teeth on the straps passing the shafts are stuck at the shaft. The push plates are connected to the curved assembling plate through engagement of the retaining hooks on the push plates with the retaining holes on the curved assembling plate. The push plates are of an elastic structure, so that outer sections or operating sections of the push plates can be compressed inward and elastically extend outward, allowing the push plates to be elastically pulled. A raised non-return retaining rib having similar structure as the non-return retaining teeth on the straps is provided on an inner side of the operating section of each of the two push plates for controlling the tightening and the loosening of the turn-back sections. With these arrangements, the fastening strap disclosed in Taiwan Patent Publication No. 239925 can be more easily adjusted to different levels of tightness, compared to other conventional fastening straps.

However, the following disadvantages are found in the fastening strap disclosed in Taiwan Patent Publication No. 239925:

(1) The two turn-back sections are exposed from the curved assembling plate to result in an unpleasant appearance and tend to tangle with other objects to adversely affect the smooth installation and operation of other nearby devices; and (2) Particularly, the two turn-back sections are separately oriented to two opposite directions, and a user has to pull the two turn-back sections with two hands in two opposite directions in order to tighten the straps. That is, the two turn-back sections could not be handled with only one hand. Therefore, for a user, such as a diver, who usually holds some other device, such as a diving torch, with one hand, it would be inconvenient or even difficult to operate the turn-back sections with two hands to adjust the tightness of the straps.

SUMMARY OF THE INVENTION

A primary object of the present invention is to provide a strap fastening device, with which it is not necessary to turn back the free ends of two fastening straps to expose the free ends from the strap fastening device.

Another object of the present invention is to provide a strap fastening device that can be easily and conveniently operated.

A further object of the present invention is to provide a strap fastening device that provides good applicability.

To achieve the above and other objects, the strap fastening device according to an embodiment of the present invention includes two elastic fastening straps and a tightness adjusting unit. The two elastic fastening straps each have a fixing end and an opposing free end. The fastening straps are pivotally connected at the fixing ends to two opposite lateral sides of the object. The tightness adjusting unit includes an assembling box and two slidable locating members. The assembling box is correspondingly provided on a left and a right half with at least one non-return retaining tooth each. The two locating members are separately slidably mounted on the assembling box and connected to the free ends of the two fastening straps. The two locating members each are provided at a predetermined position with a raised locating rib for releasably engaging with the non-return retaining teeth on the left and the right half of the assembling box. Therefore, by manipulating the two slidable locating members, the two fastening straps can be pulled, tensioned, and held in place related to the locating members. The free ends of the two fastening straps are located in the assembling box to separately connect to the two slidable locating members without being turned back to expose from the tightness adjusting unit. Thus, unlike the conventional strap fastening devices, the strap fastening device of the present invention has not exposed turn-back strap free ends to thereby avoid any interference with the smooth installation and operation of other nearby devices. That is, the fastening straps would not tangle with other nearby devices to cause any inconvenience. Furthermore, the two locating members can be conveniently slid with only one hand to adjust the tightness of the fastening straps.

According to an embodiment of the present invention, the assembling box includes a box body and a cover plate closed to each other. The box body is provided on a front face with two spaced and lengthwise extended elongated slots arranged side by side on a left and a right half of the box body, the non-return retaining teeth are separately located on an inner side of the front face above and below each of the two elongated slots, and the non-return retaining teeth located on the left and the right half of the box body are inclined in the same angle toward a central area between the left and the right half. Two opposite lateral ends of the box body are formed into two open entrances. The cover plate is closed onto a rear side of the box body opposite to the front face with the two elongated slots to thereby define a receiving space between the cover plate and the box body. The two slidable locating members respectively include a substantially U-shaped base plate and an operating plate. The U-shaped base plates provide a certain degree of elasticity and are received in the receiving space. The raised locating ribs are provided on an outer surface of the U-shaped base plates facing toward the non-return retaining teeth. The operating plates are separately perpendicularly extended from an end of the U-shaped base plates to outward project from the two elongated slots. And, the free ends of the two fastening straps are separately extended through the two open entrances of the box body into the receiving space to connect to the two slidable locating members.

According to an embodiment of the present invention, each of two the U-shaped base plates includes a rear plate portion and a front plate portion that are connected to each other and together define a sideward opened recess having an open end facing toward the central area of the box body and an opposing connected end, a notch is formed at the connected end to communicate with the sideward opened recess, and two plate-side mounting holes are formed at upper and lower ends of the connected end to separately locate above and below the notch. The operating plate is perpendicularly extended from the front plate portion at the open end of the U-shaped base plate, and the raised locating rib is formed on an outer surface of the front plate portion. The free end of each of the two fastening straps is formed into a post, in which an axially extended strap-side mounting hole is provided. By correspondingly disposing the posts at the free ends of the fastening straps in the sideward opened recesses via the notches and extending a pin through the plate-side mounting holes and the strap-side mounting hole on each of the U-shaped base plates, the two fastening straps are connected at the free ends to the two slidable locating members.

According to an embodiment of the present invention, the cover plate is provided with a plurality of retaining hooks and the box body is correspondingly provided with a plurality of retaining holes for engaging with the retaining hooks to thereby connect and close the cover plate to the box body.

According to an embodiment of the present invention, an elastic element is provided between the rear plate portion and the front plate portion of each of the slidable locating members to increase an elastic restoring force of the U-shaped base plates and ensure exact engagement of the locating ribs with the non-return retaining teeth.

According to an embodiment of the present invention, the elastic element is a spring that has sufficient elasticity to provide the U-shaped base plate with an elastic restoring force.

According to an embodiment of the present invention, the assembling box includes a first assembling box and a second assembling box arranged side by side, and a joining unit located between the first and the second assembling box to connect them to each other, such that the first and second assembling boxes can be turned about the joining unit to adjust an angle contained therebetween, allowing the assembling box to adapt to a configuration at the user's body area, to where the strap fastening device is fitted.

According to an embodiment of the present invention, the joining unit is a flexible soft pad provided on one surface of the cover plate facing away from the box body. The flexible soft pad connects the first assembling box and the second assembling box to each other and allows adjustment of an angle contained between the first and the second assembling box to ensure a comfortable contact of the first and second assembling boxes with the user's body area to where the strap fastening device is fitted.

According to an embodiment of the present invention, the joining unit includes a plurality of alternate lugs and recesses formed on two adjacent ends of the first and second assembling boxes and a first pivot shaft. The lugs on the first assembling box and the second assembling box are arranged in a staggered relation relative to one another. Each of the lugs being provided with a pivot hole, and the first pivot shaft is sequentially extended through the pivot holes on the lugs of the first and the second assembling box, such that the first and second assembling boxes can be connected together and turned about the first pivot shaft to adjust an angle contained therebetween.

According to an embodiment of the present invention, the joining unit includes a locking hook and a locking bar separately located at two adjacent inner ends of the first and second assembling boxes. The locking hook defines at an inner side thereof a locking space and is provided at a predetermined position with a notch, which communicates with the locking space. The locking bar includes a horizontally projected neck section and a retaining section perpendicularly connected to a distal end of the neck section; the retaining section is configured for rotatably fitting in the locking space with the neck section engaged with the notch, such that the first and second assembling boxes can be connected together and turned about the joint of the locking hook and the locking bar to adjust an angle contained therebetween.

According to an embodiment of the present invention, the joining unit includes a female fastener and a male fastener respectively located at two adjacent inner ends of the first and second assembling boxes. The female fastener is correspondingly provided on upper and lower sides thereof with a push element and a notch each, and the push element is located outside the notch; and the male fastener includes an upper and a lower lug, such that when the male fastener is inserted into the female fastener, the lugs are engaged with and outward projected from the notches. An angle contained between the first and the second assembling box can be adjusted at the joint of the female and the male fastener.

According to an embodiment of the present invention, the female fastener and the male fastener are pivotally turnably connected to the first assembling box and the second assembling box, respectively, via a second pivot shaft each, such that an angle contained between the first and the second assembling box can be adjusted at the joint of the female and the male fastener as well as at the second pivot shafts.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
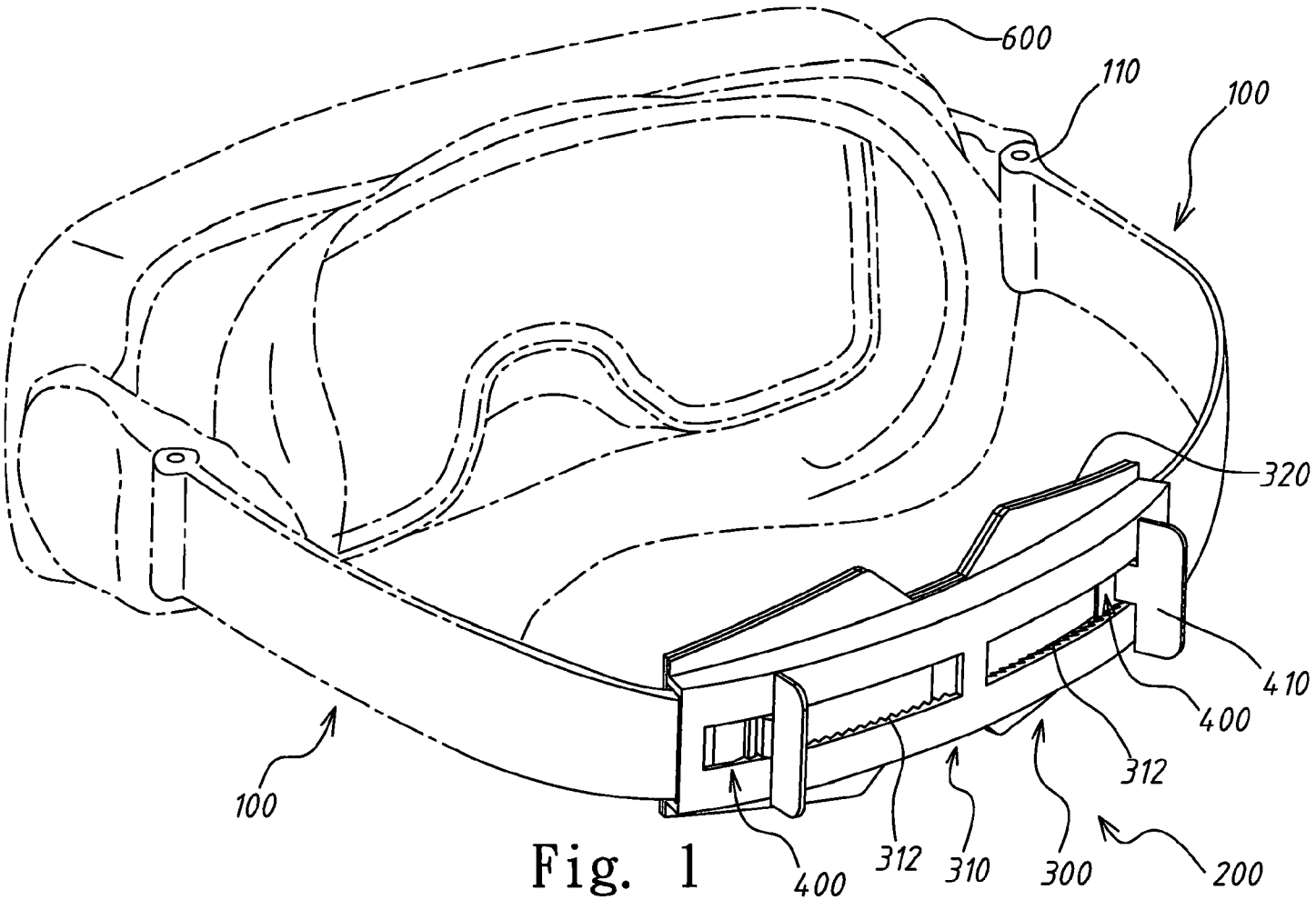
FIG. 1 is an assembled perspective view showing a strap fastening device according to a first embodiment of the present invention being connected to a diving mask.
Figure 2:
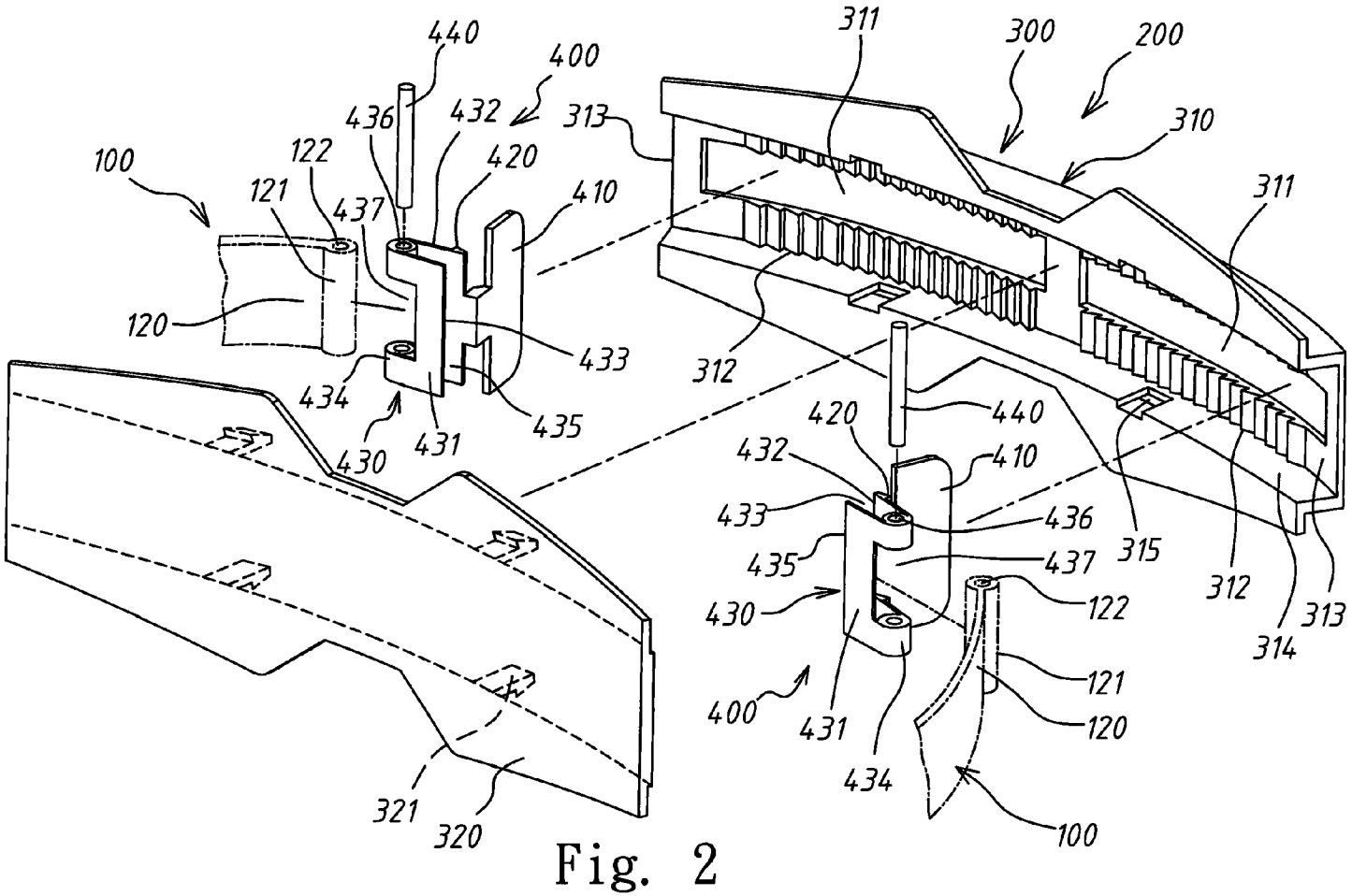
FIG. 2 is an exploded perspective view of the strap fastening device of FIG. 1.
Figure 3:
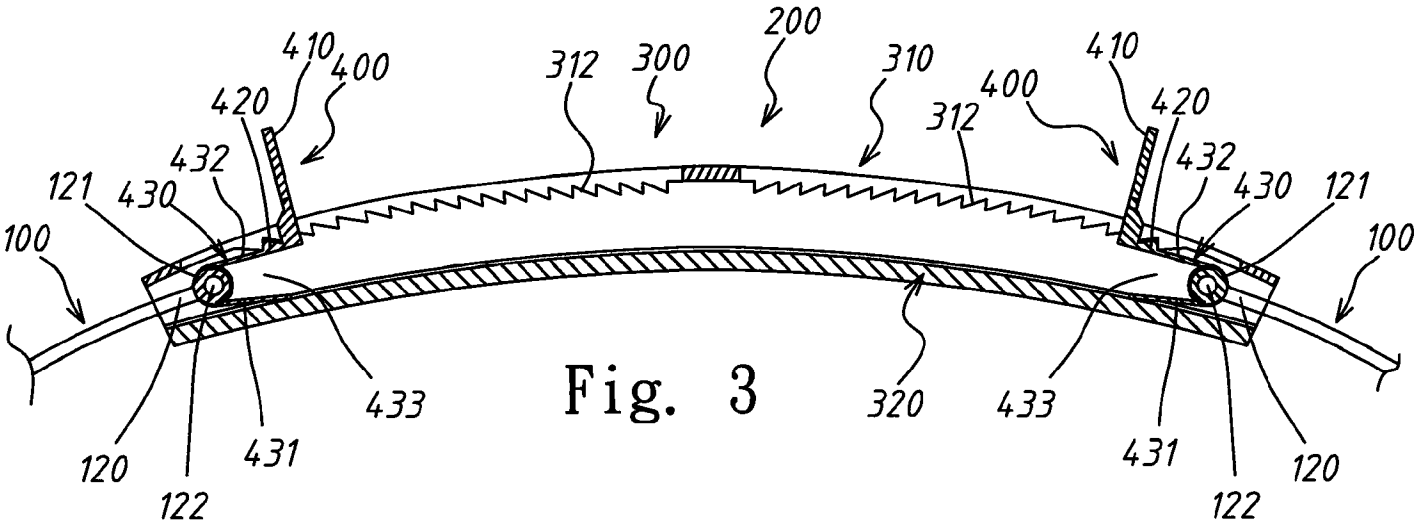
FIG. 3 is a sectional view of the strap fastening device of FIG. 1.

The present invention will now be described with some preferred embodiments thereof. For the purpose of easy to understand, elements that are the same in the preferred embodiments are denoted by the same reference numerals.

Figure 4:
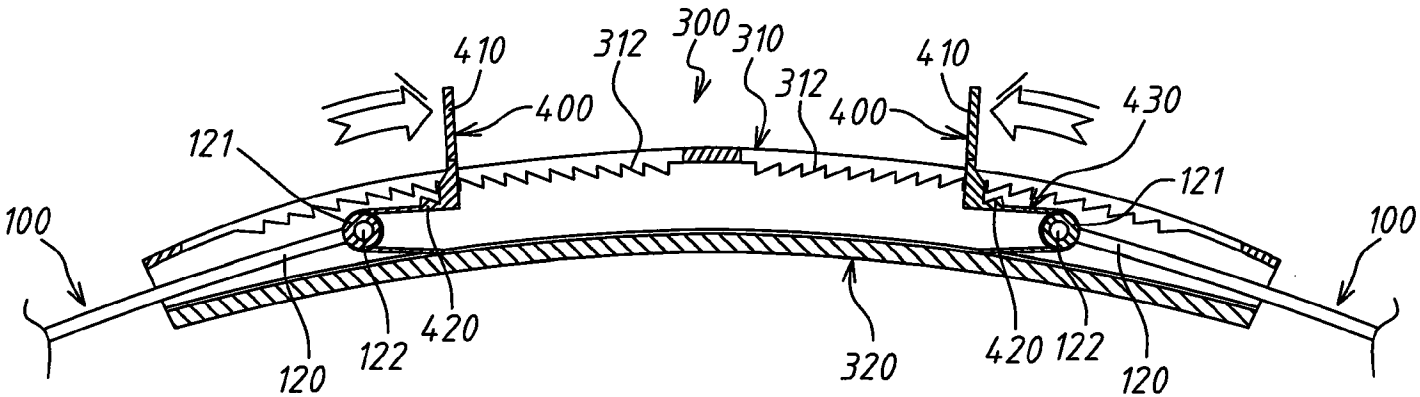
FIG. 4 shows the manner of manipulating the strap fastening device of FIG. 3.
Figure 5:
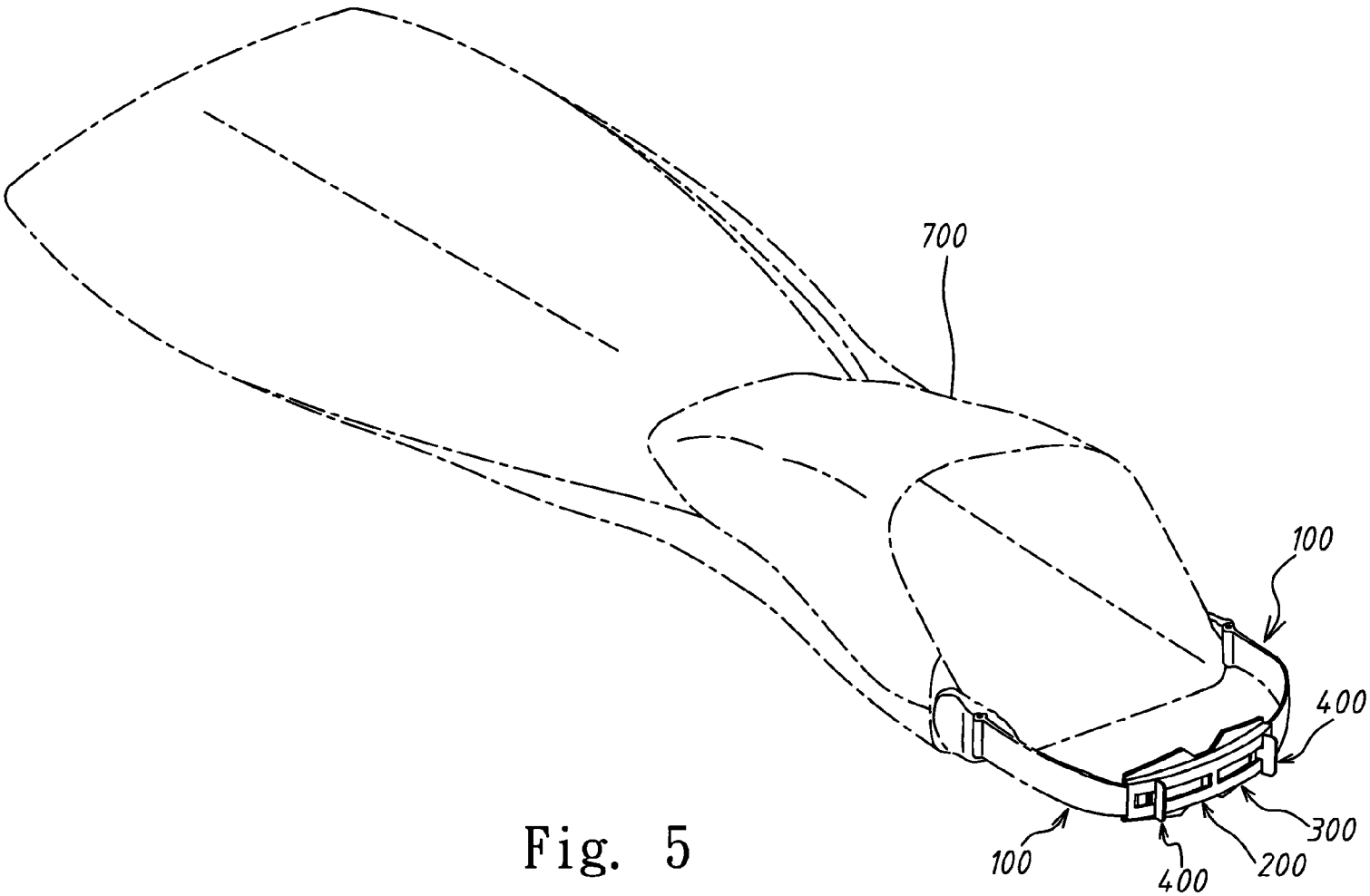
FIG. 5 shows the strap fastening device of FIG. 1 being connected to a fin.

Please refer to FIGS. 1 to 5, in which a strap fastening device according to a first embodiment of the present invention is shown. The strap fastening device is connected to two opposite lateral ends of an object, such as a diving mask 600 as shown in FIG. 1 or a fin 700 as shown in FIG. 5, and includes two fastening straps 100 and a tightness adjusting unit 200.

The two fastening straps 100 are elastic fastening straps to provide a lengthwise elasticity. Each of the two fastening straps 100 has a fixing end 110 and an opposing free end 120. The strap fastening device is pivotally connected at the fixing ends of the two fastening straps 100 to the two opposite lateral ends of an object, such as two opposite lateral ends of a diving mask 600 shown in FIG. 1 or two opposite lateral sides at a rear end of a fin 700 as shown in FIG. 5.

The tightness adjusting unit 200 includes an assembling box 300 and two slidable locating members 400. The assembling box 300 includes a box body 310 and a cover plate 320.

The box body 310 is provided at a front face with two spaced and lengthwise extended elongated slots 311, which are arranged side by side on a left and a right half of the box body. Two rows of continuously arranged non-return retaining teeth 312 are provided on an inner side of the front face separately along upper and lower edges of each of the two elongated slots 311. The non-return retaining teeth 312 in the rows corresponding to the left and right elongated slots 311 are inclined in the same angle toward a central area between the left and the right half of the box body 310. Two opposite lateral ends of the box body 310 each define an open entrance 313.

The cover plate 320 is connected to the box body 310 from a rear side thereof, such that a receiving space 314 is defined between the cover plate 320 and the box body 310. In practical implementation, the cover plate 320 and the box body 310 can be connected and closed to each other through engagement of a plurality of retaining hooks 321 provided on the cover plate 320 with a plurality of retaining holes 315 correspondingly provided on the box body 310.

Each of the two slidable locating members 400 includes a base plate 430 and an operating plate 410. The base plate 430 is bent into a substantially U-shaped configuration to provide a certain degree of elasticity. The U-shaped base plate 430 is disposed in the receiving space 314 defined between the box body 310 and the cover plate 320, and includes a rear plate portion 431 and a front plate portion 432 that are connected to each other and together define a sideward opened recess 433 having an open end 435 facing toward the central area of the box body 310 and an opposing connected end 434. Thus, the front plate portion 432 of the U-shaped base plate 430 can be elastically moved toward the rear plate portion 431 under an external force and automatically return to an original position away from the rear plate portion 431 when the external force is removed. The front plate portion 432 of the U-shaped base plate 430 is provided on an outer surface thereof with a raised locating rib 420 for releasably engaging with the non-return retaining teeth 312 above and below a corresponding one of the two elongated slots 311. The operating plate 410 is perpendicularly extended outward from the front plate portion 432 at the open end 435 of the U-shaped base plate 430, and is outward extended through a corresponding one of the two elongated slots 311, such that a user can manipulate the operating plate 410 from outside of the assembling box 300 to slide the whole locating member 400 in the receiving space 314 of the assembling box 300.

In practical implementation of the present invention, the rows of non-return retaining teeth 312 are not necessarily provided on the inner side of the box body 310. For example, the rows of non-return retaining teeth 312 can be otherwise provided on an inner side of the cover plate 320 or other suitable positions. Similarly, the raised locating ribs 420 can be correspondingly provided on the slidable locating members 400 at positions facing toward the non-return retaining teeth 312.

The free ends 120 of the two fastening straps 100 are separately extended into the receiving space 314 via the two open entrances 313 of the assembling box 300 to connect to the slidable locating members 400. To connect the free ends 120 of the fastening straps 100 to the slidable locating members 400, each of the two U-shaped base plates 430 is formed at the connected end 434 with a notch 437 communicating with the sideward opened recess 433, and at upper and lower ends of the connected end 434 with two plate-side mounting holes 436, which are separately located above and below the notch 437; meanwhile, the free end 120 of each of the fastening straps 100 is formed into a post 121, in which an axially extended strap-side mounting hole 122 is provided. By correspondingly disposing the free end 120 of each of the fastening straps 100 in the sideward opened recess 433 via the notch 437 and extending a pin 440 through the plate-side mounting holes 436 and the strap-side mounting hole 122, the two fastening straps 100 are connected at the free ends 120 to the two slidable locating members 400.

With the strap fastening device of the present invention, the free ends 120 of the two fastening straps 100 are located in the assembling box 300 to separately connect to the two slidable locating members 400 without being turned back to expose from the tightness adjusting unit 200. Thus, unlike the conventional strap fastening devices, the strap fastening device of the present invention has an integral appearance without exposed turn-back strap free ends to thereby avoid any interference with the smooth installation and operation of other nearby devices. That is, the free ends 120 of the fastening straps 100 would not tangle with other nearby devices to cause any inconvenience.

Please particularly refer to FIG. 4. When the strap fastening device of the present invention has been fitted to a desired position on the user's body and the user wants to tighten the straps 100, the user needs only to push the two operating plates 410 inward to release the raised locating ribs 420 from the non-return retaining teeth 312 in the assembling box 300. At this point, the two operating plates 410 can be moved toward the central area of the box body 310 of the assembling box 300 while pulling the free ends 120 of the two fastening straps 100 further into the assembling box 300, gradually bringing the fastening straps 100 into a tensioned state. When the fastening straps 100 have reached a desired tension to suitably tighten against the user's body, the two operating plates 410 can be released and the raised locating ribs 420 thereof would naturally engage with corresponding non-return retaining teeth 312 due to an elastic restoring force of the U-shaped base plates 430. Similarly, when it is desired to loosen the two fastening straps 100, the user needs only to push the two operating plates 410 inward to release the raised locating ribs 420 from the non-return retaining teeth 312 in the assembling box 300. At this point, the two fastening straps 100 along with the two slidable locating members 400 are gradually pulled outward by a restoring force of the previously tensioned fastening straps 100 and become relaxed. When the fastening straps 100 have reached a desired relaxed state, the two operating plates 410 can be released and the raised locating ribs 420 thereof would naturally engage with corresponding non-return retaining teeth 312 to hold the slidable locating members 400 in place in the assembling box 300 due to the elastic restoring force of the U-shaped base plates 430. To enable the above-described tightening/loosening and locating operations, the user needs only to inward push and release the two slidable locating members 400 with two fingers of one hand. Thus, the strap fastening device of the present invention is very easy and convenient to manipulate.

The non-return retaining teeth 312 are not necessarily limited to a certain fixed number. In the case there is only one non-return retaining tooth 312 provided above and below each of the two elongated slots 311, the fastening straps 100 can be adjusted to only one different tightness. In the case there is a plurality of non-return retaining teeth 312 provided above and below each of the two elongated slots 311, the fastening straps 100 can be accordingly adjusted to several different degrees of tightness.

Figure 6:
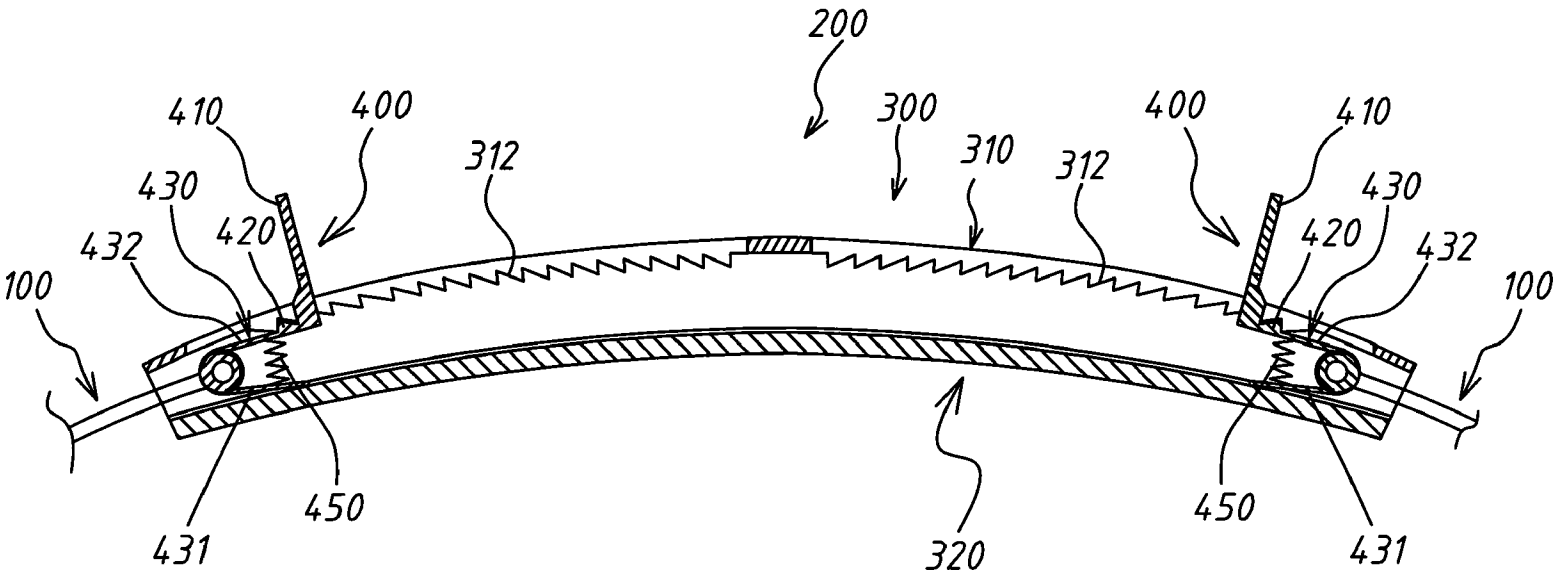
FIG. 6 is a sectional view of a strap fastening device according to a second embodiment of the present invention, which includes two springs in an assembling box thereof.

FIG. 6 is a sectional view of a strap fastening device according to a second embodiment of the present invention. The second embodiment is generally structurally similar to the first embodiment, except for an elastic element 450, such as a spring, which is further provided between the rear plate portion 431 and the front plate portion 432 of each of the two U-shaped base plates 430 of the slidable locating members 400, so as to increase the elastic restoring force of the U-shaped base plates 430 and ensure exact engagement of the raised locating ribs 420 with the non-return retaining teeth 312.

Figure 7:
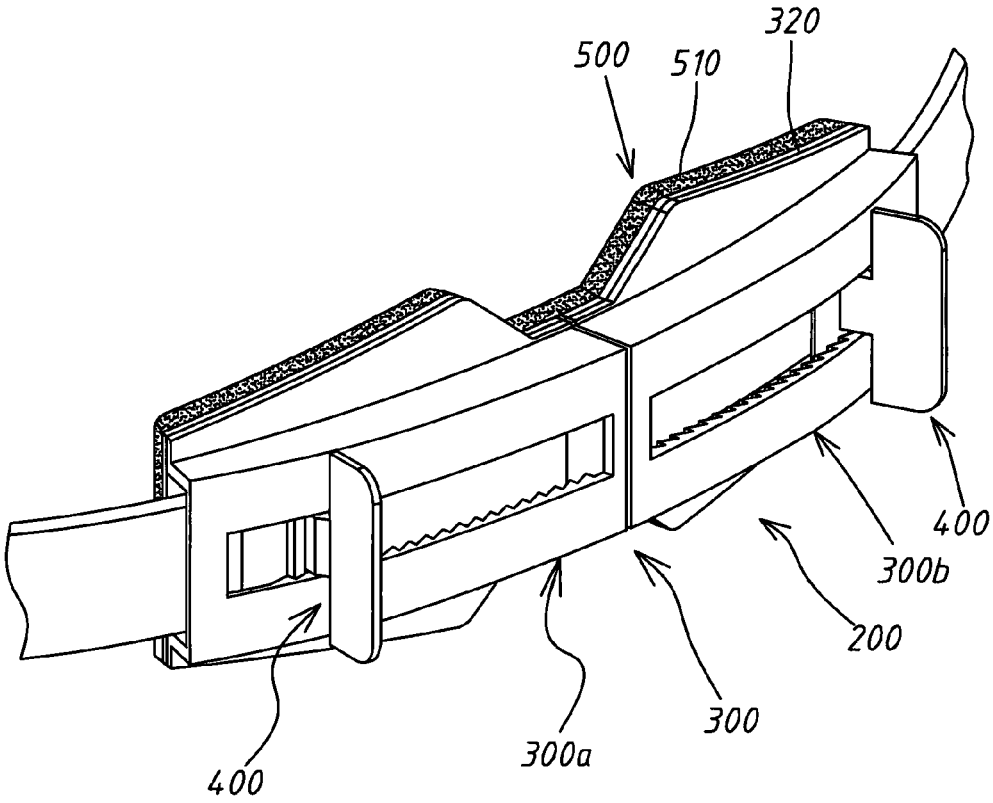
FIG. 7 is an assembled perspective view of a strap fastening device according to a third embodiment of the present invention, which includes two assembling boxes connected to each other via a flexible pad.

FIG. 7 is an assembled perspective view of a strap fastening device according to a third embodiment of the present invention, which is generally structurally similar to the previous two embodiments, except that the assembling box 300 is configured to be angularly adjustable to adapt to a configuration of the user's body area to where the strap fastening device is fitted. To do so, the assembling box 300 includes a first assembling box 300*a* and a second assembling box 300*b* arranged side by side and connected to each other via a joining unit 500 located between them. With these arrangements, the assembling box 300 can be bent at the joining unit 500, and an angle contained between the first and the second assembling box 300*a*, 300*b* can be adjusted to adapt to the configuration of the user's body area, to which the strap fastening device is fitted.

The joining unit 500 can be in the form of, for example, a flexible soft pad, a pivot joint, a locking hook assembly, a side-release buckle, and so on. In the third embodiment illustrated in FIG. 7, the joining unit 500 is a flexible soft pad 510 attached to one surface of the cover plate 320 facing away from the box body 310.

The flexible soft pad 510 connects the first assembling box 300*a* and the second assembling box 300*b* to each other and allows adjustment of an angle contained between the first and the second assembling box 300*a*, 300*b* to ensure a comfortable contact of the first and second assembling boxes with the user's body area.

Figure 8:
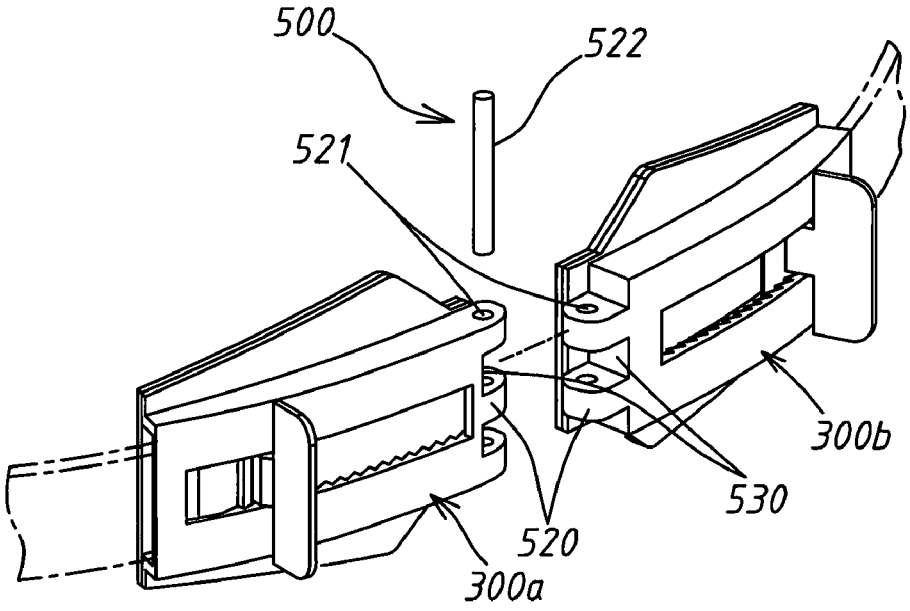
FIG. 8 is an exploded perspective view of a strap fastening device according to a fourth embodiment of the present invention, which includes two assembling boxes connected to each other via a pivot shaft.

FIG. 8 is an exploded perspective view of a strap fastening device according to a fourth embodiment of the present invention, which is structurally similar to the third embodiment, except that the joining unit 500 thereof includes a plurality of alternate lugs 520 and recesses 530 formed on two adjacent ends of the two assembling boxes 300*a*, 300*b*. The lugs 520 formed on the first assembling box 300*a* and on the second assembling box 300*b* are arranged in a staggered relation relative to one another, so that the recesses 530 on the first assembling box 300*a* and on the second assembling box 300*b* are also arranged in a staggered relation relative to one another. Each of the lugs 520 is provided with a pivot hole 521. By aligning the pivot holes 521 with one another and extending a first pivot shaft 522 through the aligned pivot holes 521, the first and the second assembling boxes 300*a*, 300*b* are connected to each other and can be pivotally turned about the first pivot shaft 522 relative to each other to adjust an angle contained therebetween.

Figure 9:
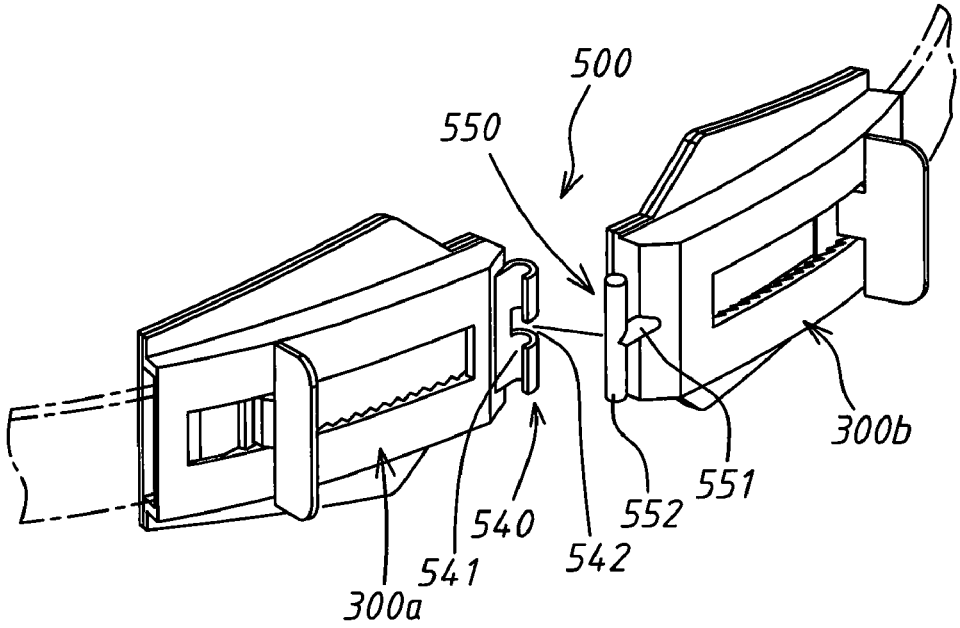
FIG. 9 is an exploded perspective view of a strap fastening device according to a fifth embodiment of the present invention, which includes two assembling boxes connected to each other via a locking hook and a locking bar.

FIG. 9 is an exploded perspective view of a strap fastening device according to a fifth embodiment of the present invention, which is structurally similar to the third embodiment, except that the joining unit 500 thereof includes a locking hook 540 and a locking bar 550 separately located at two adjacent inner ends of the first and second assembling boxes 300*a*, 300*b*. The locking hook 540 defines at an inner side thereof a locking space 541, and is provided at a predetermined position with a notch 542, which communicates with the locking space 541. The locking bar 550 includes a horizontally projected neck section 551 and a retaining section 552 perpendicularly connected to a distal end of the neck section 551. The retaining section 552 is configured for rotatably fitting in the locking space 541 with the neck section 551 engaged with the notch 542. With these arrangements, the first and the second assembling boxes 300*a*, 300*b* are connected to each other via the joining unit 500 and can be pivotally turned relative to each other at a joint of the locking hook 540 and the locking bar 550 to adjust an angle contained therebetween.

Figure 10:
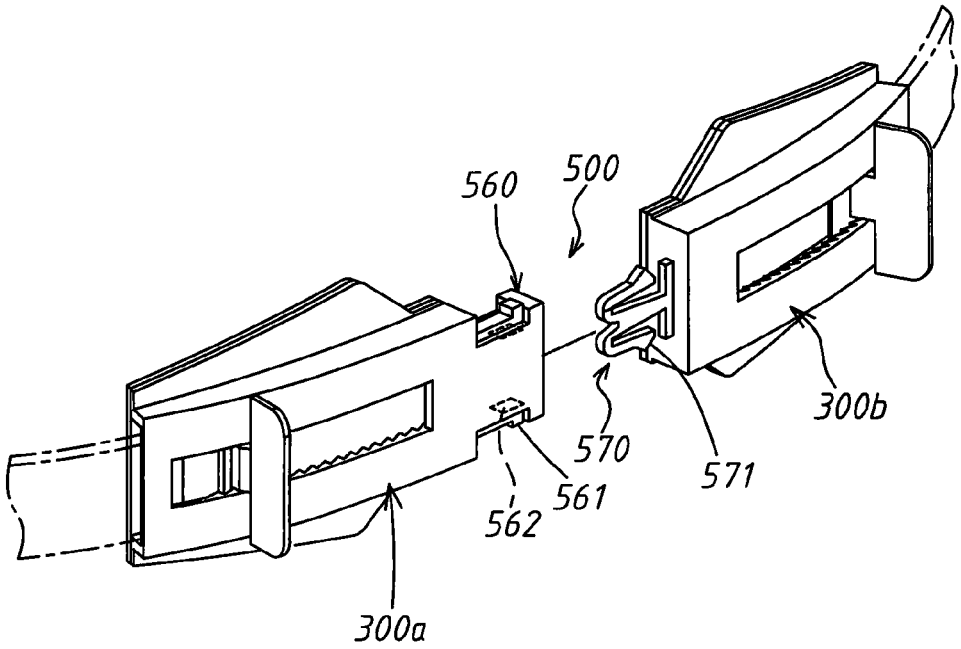
FIG. 10 is an exploded perspective view of a strap fastening device according to a sixth embodiment of the present invention, which includes two assembling boxes connected to each other via engagement of a female fastener with a male fastener.

FIG. 10 is an exploded perspective view of a strap fastening device according to a sixth embodiment of the present invention, which is structurally similar to the third embodiment, except that the joining unit 500 thereof includes a female fastener 560 and a male fastener 570 separately located at two adjacent inner ends of the first and second assembling boxes 300*a*, 300*b*. The female fastener 560 is correspondingly provided on upper and lower sides thereof with a push element 561 and a notch 562 each, and the push element 561 is located outside the notch 562; and the male fastener 570 includes an upper and a lower lug 571. When the male fastener 570 is inserted into the female fastener 560, the lugs 571 are engaged with and outward projected from the notches 562. And, when the push elements 561 are pushed, the lugs 571 are released from the notches 562 to separate the first and the second assembling box 300*a*, 300*b* from each other. An angle contained between the first and the second assembling box 300*a*, 300*b* can be adjusted at a joint of the female and the male fastener 560, 570.

Figure 11:
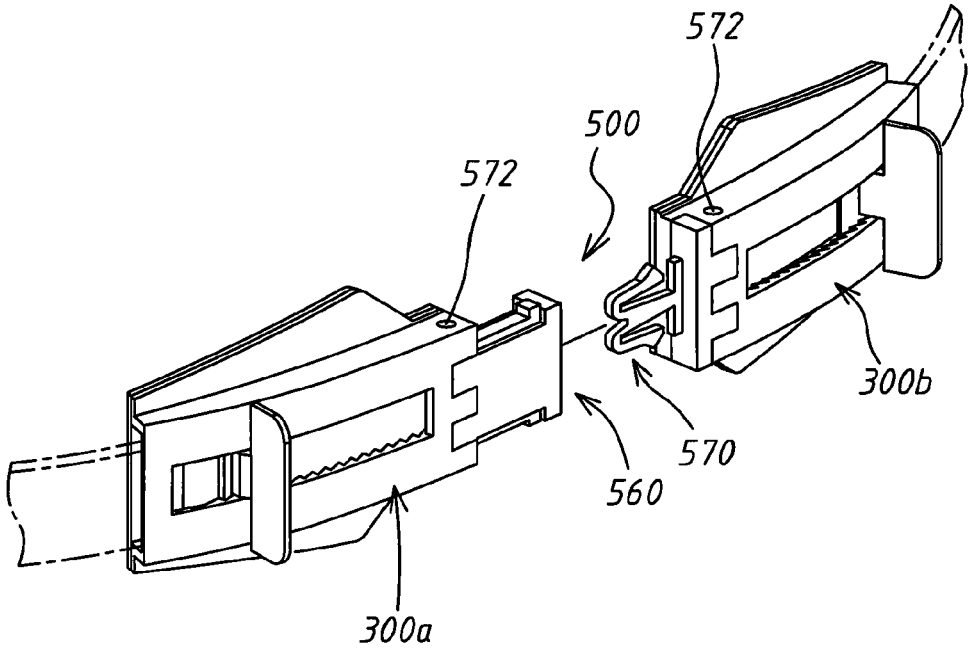
FIG. 11 is an exploded perspective view of a strap fastening device according to a seventh embodiment of the present invention, which includes two assembling boxes connected to each other via engagement of a female fastener with a male fastener that are pivotally connected to the assembling boxes via a pivot shaft each.

FIG. 11 is an exploded perspective view of a strap fastening device according to a seventh embodiment of the present invention, which is structurally similar to the sixth embodiment, except that the female fastener 560 and the male fastener 570 of the joining unit 500 are separately pivotally connected via a second pivot shaft 572 to two adjacent inner ends of the first assembling box 300*a* and the second assembling box 300*b*. Therefore, the first assembling box 300*a* and the second assembling box 300*b* can be pivotally turned relative to each other at a joint of the female fastener 560 and the male fastener 570 as well as at the second pivot shafts 572 to thereby adjust an angle contained therebetween.

According to the present invention, each of the above-described fourth to seventh embodiments can be further provided on one surface of the cover plate 320 facing away from the box body 310 with the flexible soft pad 510 to enable a comfortable contact of the first and second assembling boxes 300*a*, 300*b* with the user's body area.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A strap fastening device for connecting to two opposite lateral ends of an object, comprising:

two elastic fastening straps, each of which having a fixing end and an opposing free end;

the fastening straps being pivotally connected at the fixing ends to the two opposite lateral ends of the object; and a tightness adjusting unit including:

an assembling box being correspondingly provided on a left and a right half with at least one non-return retaining tooth each; and two slidable locating members being separately slidably mounted on the assembling box and connected to the free ends of the two fastening straps; the two slidable locating members each being provided at a predetermined position with a raised locating rib for correspondingly releasably engaging with the non-return retaining teeth on the left and the right half of the assembling box, wherein the assembling box includes a box body and a cover plate closed to each other;

the box body being provided on a front face with two spaced and lengthwise extended elongated slots arranged side by side on a left and a right half of the box body, the non-return retaining teeth being separately located on an inner side of the front face above and below each of the two elongated slots, and the non-return retaining teeth located on the left and the right half of the box body being inclined in the same angle toward a central area between the left and the right half; and two opposite lateral ends of the box body being formed into two open entrances;

the cover plate being closed onto a rear side of the box body opposite to the front face with the two elongated slots to thereby define a receiving space between the cover plate and the box body; and wherein the two slidable locating members each include a substantially U-shaped base plate and an operating plate; the U-shaped base plates providing a certain degree of elasticity and being received in the receiving space of the assembling box, and the raised locating ribs being provided on an outer surface of the U-shaped base plates facing toward the non-return retaining teeth; and the operating plates being separately perpendicularly extended from an end of the U-shaped base plates to outward project from the two elongated slots; and the free ends of the two fastening straps being separately extended through the two open entrances of the box body into the receiving space to connect to the two slidable locating members.

2. The strap fastening device as claimed in claim 1, wherein each of two the U-shaped base plates includes a rear plate portion and a front plate portion that are connected to each other and together define a sideward opened recess having an open end facing toward the central area of the box body and an opposing connected end; a notch being formed at the connected end to communicate with the sideward opened recess, and two plate-side mounting holes being formed at upper and lower ends of the connected end to separately locate above and below the notch; the operating plate being perpendicularly extended from the front plate portion at the open end of the U-shaped base plate, and the raised locating rib being formed on an outer surface of the front plate portion; and wherein the free end of each of the two fastening straps is formed into a post, in which an axially extended strap-side mounting hole is provided; whereby by disposing the free end of each of the fastening straps in the sideward opened recess via the notch and extending a pin through the plate-side mounting holes and the strap-side mounting hole, the two fastening straps are connected at the free ends to the two slidable locating members.

3. The strap fastening device as claimed in claim 2, wherein the cover plate is provided with a plurality of retaining hooks and the box body is correspondingly provided with a plurality of retaining holes for engaging with the retaining hooks to thereby connect and close the cover plate to the box body.

4. The strap fastening device as claimed in claim 2, further comprising an elastic element located between the rear plate portion and the front plate portion of each of the slidable locating members.

5. The strap fastening device as claimed in claim 4, wherein the elastic element is a spring.

6. The strap fastening device as claimed in claim 2, wherein the assembling box includes a first assembling box and a second assembling box arranged side by side, and a joining unit located between the first and the second assembling box to connect them to each other.

7. The strap fastening device as claimed in claim 6, wherein the joining unit is a flexible soft pad attached to one surface of the cover plate facing away from the box body.

8. The strap fastening device as claimed in claim 6, wherein the joining unit includes a plurality of alternate lugs and recesses formed on two adjacent ends of the first and second assembling boxes and a first pivot shaft; the lugs on the first assembling box and the second assembling box being arranged in a staggered relation relative to one another, so that the recesses on the first assembling box and on the second assembling box are also in a staggered relation relative to one another; each of the lugs being provided with a pivot hole, and the first pivot shaft being sequentially extended through the pivot holes on the lugs of the first and the second assembling box.

9. The strap fastening device as claimed in claim 8, wherein the cover plate is provided on one surface facing away from the box body with a flexible soft pad.

10. The strap fastening device as claimed in claim 6, wherein the joining unit includes a locking hook and a locking bar separately located at two adjacent inner ends of the first and second assembling boxes; the locking hook defining at an inner side thereof a locking space and being provided at a predetermined position with a notch, which communicates with the locking space; the locking bar including a horizontally projected neck section and a retaining section perpendicularly connected to a distal end of the neck section; the retaining section being configured for rotatably fitting in the locking space with the neck section engaged with the notch.

11. The strap fastening device as claimed in claim 10, wherein the cover plate is provided on one surface facing away from the box body with a flexible soft pad.

12. The strap fastening device as claimed in claim 6, wherein the joining unit includes a female fastener and a male fastener respectively located at two adjacent inner ends of the first and second assembling boxes; the female fastener being correspondingly provided on upper and lower sides thereof with a push element and a notch each, and the push element being located outside the notch; and the male fastener including an upper and a lower lug; whereby when the male fastener is inserted into the female fastener, the lugs are engaged with and outward projected from the notches.

13. The strap fastening device as claimed in claim 12, wherein the female fastener and the male fastener are pivotally turnably connected to the first assembling box and the second assembling box, respectively, via a second pivot shaft each.

14. The strap fastening device as claimed in claim 13, wherein the cover plate is provided on one surface facing away from the box body with a flexible soft pad.

15. The strap fastening device as claimed in claim 12, wherein the cover plate is provided on one surface facing away from the box body with a flexible soft pad.

* * * * *